US008702191B2

(12) United States Patent
Pedra et al.

(10) Patent No.: US 8,702,191 B2
(45) Date of Patent: Apr. 22, 2014

(54) PRINTER CONTROL METHOD AND SYSTEM

(75) Inventors: Pere Esterri Pedra, Sant Cugat del Valles cat (ES); David Soriano Fosas, Terrassa BCN (ES); Javier González Bruno, Terrassa Barcelona (ES); Eduard Pamies Corominas, Tarragona Tarragona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 97 days.

(21) Appl. No.: 13/542,340

(22) Filed: Jul. 5, 2012

(65) Prior Publication Data

US 2014/0009521 A1 Jan. 9, 2014

(51) Int. Cl.
*B41J 29/38* (2006.01)
*B41J 2/045* (2006.01)

(52) U.S. Cl.
CPC ..... *B41J 2/0455* (2013.01); *B41J 2/0459* (2013.01); *B41J 2/0457* (2013.01)
USPC ..... 347/10

(58) Field of Classification Search
CPC ..... B41J 2/0455; B41J 2/0457
USPC ..... 327/382
See application file for complete search history.

(56) References Cited

U.S. PATENT DOCUMENTS

| | | | | |
|---|---|---|---|---|
| 6,068,360 | A | 5/2000 | Hiwada | |
| 6,183,056 | B1 | 2/2001 | Corrigan et al. | |
| 6,328,397 | B1 | 12/2001 | Shimizu et al. | |
| 6,382,774 | B1 * | 5/2002 | Izumi | 347/61 |
| 8,002,374 | B2 | 8/2011 | Imanaka et al. | |
| 2002/0158930 | A1 * | 10/2002 | Hirayama | 347/14 |
| 2005/0140707 | A1 * | 6/2005 | Imanaka et al. | 347/9 |
| 2006/0164446 | A1 | 7/2006 | Beak | |
| 2013/0015889 | A1 * | 1/2013 | Kesler | 327/109 |

OTHER PUBLICATIONS

Jian-Chiun Liou et al., "Design and Fabrication of Monolithic Multidimensional Data Registration CMOS/MEMS Ink-Jet Printhead," Journal of Microelectromechanical Systems, vol. 19, No. 4, Aug. 2010, pp. 961-972.

* cited by examiner

*Primary Examiner* — Shelby Fidler

(57) ABSTRACT

A method and apparatus for controlling firing energy in a printer pen of a thermal inkjet printer are described. A digital voltage value representative of a voltage output by a printer-pen power supply is obtained. The printer-pen power supply is electrically coupled to a switch. The switch is electrically coupled to a nozzle resistor and is controlled using a switch logic signal. A voltage level of the switch logic signal is set based on said digital voltage value and a voltage drop due to a parasitic resistance between the printer-pen power supply and the switch.

20 Claims, 3 Drawing Sheets

PRINTER CONTROL METHOD AND SYSTEM

BACKGROUND

Ink-jet printing mechanisms use printer pens that shoot droplets of ink onto a print medium to generate an image. Such mechanisms may be used in a wide variety of applications, including computer printers, plotters, copiers, and facsimile machines. An ink-jet printer typically includes a printhead having a plurality of independently addressable firing units. Each firing unit includes an ink chamber connected to an ink source, which may be a common ink source, and to an ink outlet nozzle. A transducer within the chamber provides the impetus for expelling ink droplets through the nozzles. In thermal ink-jet printers, the transducers are thin-film firing resistors that generate sufficient heat during application of a brief voltage pulse to vaporize a quantity of ink. This vaporization is then sufficient to expel a liquid droplet. It is useful to increase the efficiency of an ink-jet printer that uses a printer pen.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure, and wherein.

DETAILED DESCRIPTION

Examples of a method, apparatus and computer program product are described. The examples are particularly beneficial for thermal inkjet printers. The examples have an effect of increasing the thermal efficiency of a thermal inkjet pen. This is achieved by controlling a voltage level of a switch logic signal used to switch a transducer on and off. The transducer is typically a nozzle resistor arranged to eject ink from the printer pen. The voltage level of the switch logic signal is set based on a digital voltage value representative of a voltage output by a printer-pen power supply. The digital voltage value is obtained or measured so that the voltage level of a switch logic signal can be set to accommodate variations in the printer-pen power supply. The voltage level of the switch logic signal may also take into account a voltage drop due to a parasitic resistance between the printer-pen power supply and the switch.

Figure 1:
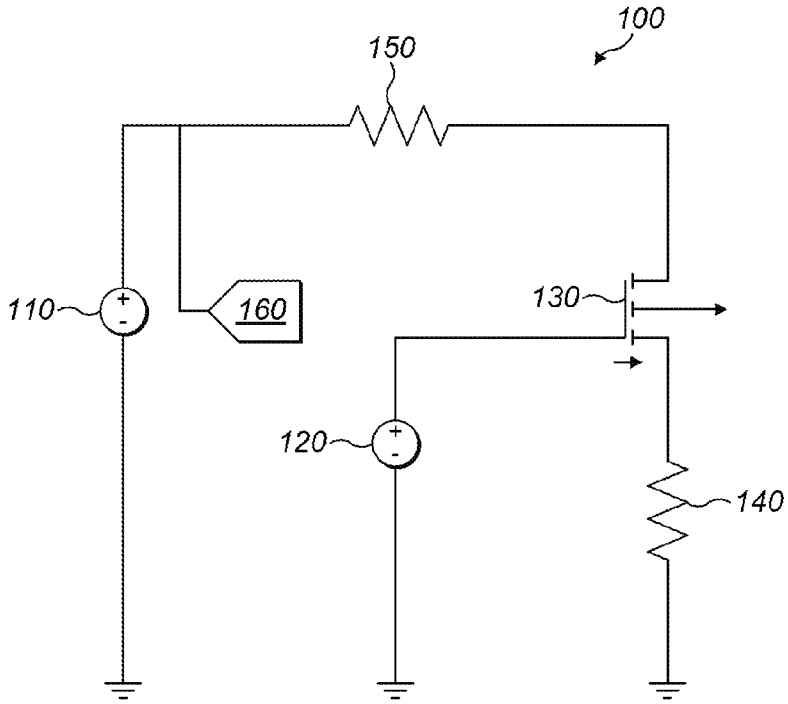
FIG. 1 is a schematic circuit diagram of an apparatus for controlling firing energy in a thermal inkjet printer with a printer pen according to an example.

FIG. 1 shows an example of an apparatus 100 for use with a thermal inkjet printer. At least a portion of the apparatus 100 may be a printer pen. The term 'printer pen' is used herein to refer to a component of a thermal inkjet printer that ejects ink onto a print medium. A 'printhead' may comprise one or more printer pens. A printer pen may form at least a portion of a print cartridge. A printer pen and/or print cartridge may be fixed or removable in relation to the printer. One or more printer pens may be coupled to a fixed or removable ink supply, such as an ink cartridge. As such a removable print cartridge may comprise one or more printer pens and one or more ink cartridges. Different printer pens may be supplied for different ink colors and/or a single printer pen may have different columns of nozzles for different colors. The printer pen is electrically coupled to a printer-pen power supply 110. In certain examples a removable printer pen may comprise a power supply pin that electrically couples the printer pen to a printer-pen power supply, such as a power supply forming part of the thermal inkjet printer. The printer-pen power supply 110 may be a direct-current (DC) power supply, and may supply a voltage at around 32V.

The printer-pen power supply 110 provides a voltage to switch 130. The switch 130 may be a transistor such as a field-effect transistor as illustrated in FIG. 1, although other switching components may alternatively be used. The switch 130 is electrically coupled in series with a transducer, which in the present example is a nozzle resistor 140. In FIG. 1, a first side of the nozzle resistor 140 is coupled to a drain terminal of the switch 130. A second side of the nozzle resistor 140 is coupled to ground. A source terminal of the switch 130 is electrically coupled to the printer-pen power supply 110 through a power supply coupling. The power supply coupling may have a resistance. The resistance may be a parasitic resistance 150. The parasitic resistance 150 may be the resistance of the conductive path from a printhead power supply pin up to the nozzle resistor 140, or at least an approximation of this resistance. The parasitic resistance 150 may depend on an operational state of the printer pen, for example the number of nozzle resistors that are simultaneously active. In the example of FIG. 1 the switch 130 is controlled via a logic signal line coupled to a gate terminal of the switch 130. The logic signal line is, in turn, electrically coupled to an effective logic power supply 120 that provides a switch logic signal to control the switch 130. The logic power supply 120 may for part of, or may be external to, the printer pen. For example, in certain cases the printer-pen power supply 110 and the logic power supply 120 are mounted on a printer-side and electrically coupled to a printer pen via appropriate pin couplings.

The energy applied to nozzle resistor 140 affects performance, durability, and efficiency. It is known that the firing energy must be above a certain threshold to cause a vapor bubble to nucleate. Above this threshold in a transitional range, increasing the energy increases the drop volume expelled. Above a higher threshold at the upper limit of the transitional range, drop volumes do not increase with increasing energy. It is in this range in which drop volumes are stable even with moderate energy variations that printing ideally takes place.

The switch logic signal controls the switch 130 that in turn controls the energy applied to the nozzle resistor 140. The switch logic signal has a voltage level and may comprise a pulse-width modulated voltage signal. In the latter case, the voltage level sets the amplitude of activation pulses. In an implementation, the pulse width of the activation pulses of the switch logic signal is set by a control procedure or controller that determines the thermal turn on energy (TTOE) based on the considerations described above. The higher the voltage of the switch logic signal, the higher the energy expended in the nozzle.

The pulse width is the duration of the energy pulse. It is also used to adjust the energy by the TTOE procedure.

The voltage output by a printer-pen power supply is prone to variations. These may be variations within a manufacturer's tolerance ranges. Power supplies having smaller tolerance ranges are typically more complex and/or more expensive. Additionally, the voltage output by the power supply may change with time and/or with use. It also differs with printer pen and/or thermal inkjet printer.

The voltage level of the switch logic signal is required to match the voltage level supplied to the source terminal of the switch 130. In certain cases, a voltage at a gate terminal of the switch 130 may be around 2 V higher than a voltage at a source terminal. When an appropriate match is fulfilled, ink can be successfully ejected by the nozzle resistor 140 in the stable range of energies described above.

When using a comparative thermal inkjet printer, a default voltage value of the switch logic signal is selected for all printers at a design stage based on a worst-case scenario of power supply variations. For example, it may be hard-wired into control circuitry based on the maximum variation expected in the tolerance ranges. For example, if a power supply unit delivers a voltage of 32 V with a tolerance range of +/−2V, a default voltage value of the switch logic signal may be set as 30 V. In this comparative example, the switch logic signal is set at 30 V for all printers during manufacture, e.g. this may be the chosen voltage level for a switch power supply.

As energy levels increase above a higher threshold at the upper limit of the transitional range, as described above, uniformity of ink drops is not compromised. However, energy is wasted and the printer components are prematurely aged due to excessive heating and ink residue build up. Heating due to increased energies can also lead to slower printing, e.g. it takes longer to activate nozzle resistors. The examples described herein set the voltage level of the switch logic signal based on measured voltage values supplied by an individual printer-pen power supply. Changing the value of the voltage level of the switch logic signal does not affect the voltage or the current supplied by the printer-pen power supply. It does however prevent wasted energy, increasing the thermal efficiency of the printer. In effect, if nozzle energy is regulated by controlling a switch gate voltage, the energy dissipated in heat in a thermal inkjet printer pen can be minimized.

Figure 2:
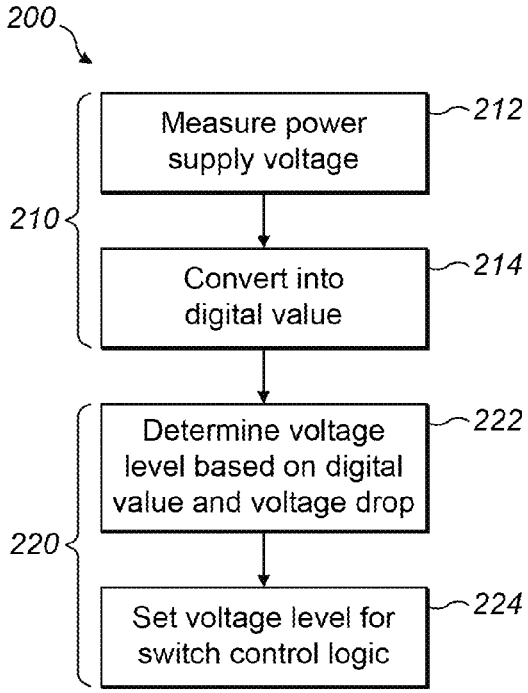
FIG. 2 is a flow diagram of an method for controlling firing energy in a thermal inkjet printer with a printer pen according to an example.

A method 200 for setting a voltage level of a switch logic signal according to an example is shown in FIG. 2. The method 200 will be described in relation to the apparatus of FIG. 1 but it may also be equally applied to other apparatus. In a first set of blocks 210, a digital voltage value representative of a voltage output by a printer-pen power supply is obtained. The printer-pen power supply may be printer-pen power supply 110. In particular, at block 212 a power supply voltage is measured on a power supply coupling that supplies power to a switch, such as switch 130. The voltage is measured on the printer-pen power supply side, i.e. within a predetermined electrical distance from the printer-pen power supply. At block 214, the measured voltage is converted into a digital value. In FIG. 1, there is control circuitry comprising a measurement device 160 that measures a voltage and converts it into a digital value. Measurement device 160 may be an off-the-shelve device for measuring a voltage and converting it into a digital value. Measurement device 160 may be mounted in the printer pen or on a printer-side of a removable printhead. The latter case provides advantages by not adding to the size and cost of printer consumables. Measurement device 160 may comprise a built-in analog-to-digital convertor (ADC) to output a binary bit sequence representative of the voltage output from the printer-pen power supply. The bit sequence may have a length set by the constraints of the implementation, e.g. may be an 8, 16 or 32 bit value. The bit sequence may be stored in a local register, i.e. a memory, and/or communicated to control circuitry such as a microcontroller. Measurement device 160 may also, in some implementations, comprise an analog voltage measurement circuit coupled to an analog-to-digital convertor or arranged to output a digital value.

Returning to FIG. 2, in a second set of blocks 220, a voltage level of the switch logic signal is set. The energy that a printer nozzle sees depends on an applied voltage and its duration. In certain described examples, the voltage is directly set by the switch logic signal. In block 222, a voltage level of the switch logic signal is determined. This may be performed between control circuitry (not shown in FIG. 1) such an on or off-chip microcontroller. It may also be set based on higher-level control program code, for example, that is being processed after retrieval from memory in a processing apparatus, such as an embedded processing system. Circuitry may form part of a printer body coupled to a removable printer pen and/or may form part of a removable printer pen. In block 222 of FIG. 2, the voltage level of the switch logic signal is calculated based on the digital voltage value output from block 214 and a voltage drop due to a parasitic resistance between the printer-pen power supply and the switch, for example a voltage drop due to parasitic resistance 150. This may be performed by retrieving a previously-stored digital voltage value from a local register representative of the voltage output from the printer-pen power supply and subtracting a digital voltage value representative of the voltage drop due to parasitic resistance 150. The digital voltage value representative of the voltage drop due to parasitic resistance 150 may be retrieved from a register or other memory based on a pre-set and/or measured value. For example, if the parasitic resistance 150 may be predicted for a printer pen, e.g. based on the number of nozzles firing simultaneously it may be determined dynamically by control circuitry based on current activation parameters such as nozzle control signals. Alternatively, at a manufacturing or pre-installation stage, the parasitic resistance 150 may be measured and characterised, for example at a single value or set of values dependent on operating parameters. Digital values representative of the measured and characterised parasitic resistance may then be stored in memory coupled to the control circuitry such that they can be retrieved for block 222. In a further case, the voltage drop may be based on measured values, for example a voltage measurement on the switch-side of the power-supply coupling.

In any case, control circuitry is capable of determining digital voltage value representative of the voltage drop due to parasitic resistance 150, which may be stored as a digital variable, e.g. a bit sequence, and subtracted from a digital variable representative of the measured power supply voltage, e.g.:

$$V_{LOGIC\ SIGNAL}=V_{ADC}-V_{VOLTAGE\ DROP}.$$

This calculation may be coded as part of computer program code, e.g. firmware, in control circuitry such as a microcontroller. At block 224, a voltage level for the switch logic signal is set. This may be performed by setting an output voltage value of a logic power supply 120 based on the digital value determined at block 222, i.e. $V_{LOGIC\ SIGNAL}$, or communicating a voltage level to the logic power supply 120. In certain variations the switch logic signal may be further modified by a TTOE procedure, e.g. to reduce the energy supplied to a nozzle; in this case $V_{LOGIC\ SIGNAL}$ sets an upper bound on the voltage level of the switch logic signal.

Examples disclosed herein minimise a difference between a value of a printer-pen power supply voltage, e.g. received at a source terminal, of a switch and a value of a voltage used to control said switch, e.g. received at a gate terminal. This is achieved by measuring the printer-pen supply voltage for an individual printer and setting a switch logic signal for each printhead to match said printer-pen supply voltage as received by the switch, e.g. accommodating a voltage drop in a power supply coupling. These examples thus take into account variations in individual printer-pen power supply voltage, i.e. by setting the switch logic signal based on an actual measured value for an individual printer-pen power supply voltage. The switch logic signal may be supplied by an independent switch power supply. The examples increase thermal ink-jet pen thermal efficiency. They also allow the specifications for the printer-pen power supply to be relaxed, e.g. variations can be accommodated. This in turn removes a need for a precise and expensive power supply unit, cheaper power supplies with wider tolerances can be used. Rather than adjust a firing pulse based on circuitry coupled to the power supply, certain described examples adjust the voltage at a gate terminal of a transistor that controls the firing of a nozzle resistor. These examples thus change the energy delivered to the nozzle in a manner that is distinguished from comparative examples.

Experimental data demonstrating advantages provided by the above examples will now be described. The data will be described in relation to an printhead example that has nozzles arranged in 'trenches' or columns, one for each color. In a four color printing system there are trenches for yellow, magenta, cyan, and black. The tests were carried out on a dry, wire-bonded printer pen, a dry printer pen being in this case a printhead that has not been filled with ink. In actual operation, printer pens will be coupled to an ink supply. In this system when using a TTOE routine with 1 trench at 25% Area fill (AF—i.e. in a printing operation would fill 25% of an area on a print medium) at 14 kHz firing frequency there is a power supply voltage variation of −100 mV and a switch logic signal variation of 140 mV. At high load conditions, with 4 trenches, 100% AF at 12 kHz firing frequency, there is a power supply voltage variation of −850 mV and a switch logic signal variation of 190 mV. This demonstrates that the switch logic signal is relatively stable with loading and that a voltage drop due to a parasitic resistance dependent on loading is around 1 V.

Figure 3A:
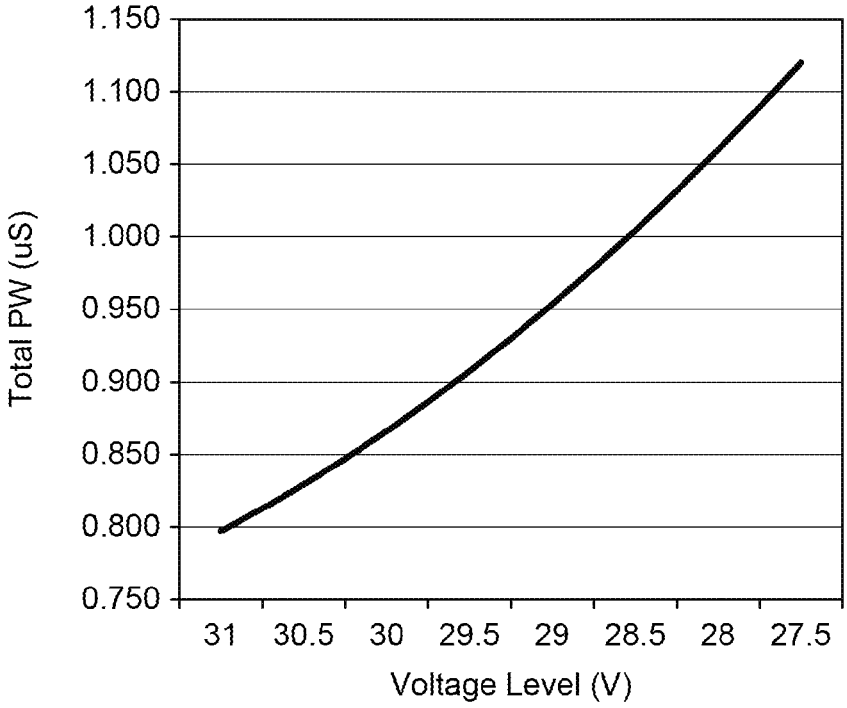
FIGS. 3A, 3B and 3C are charts showing changes in output with different voltage levels according to an example.
Figure 3B:
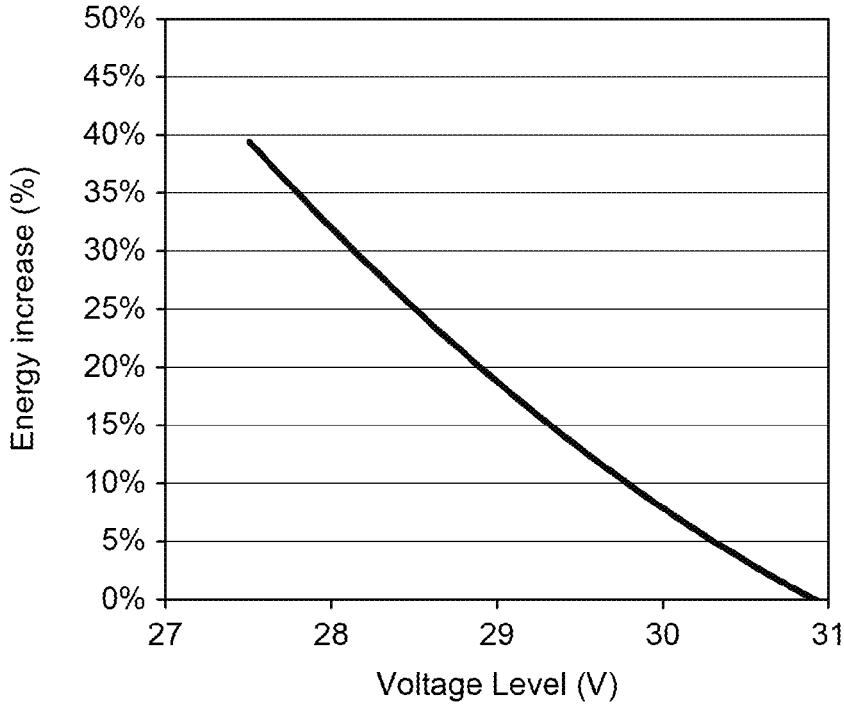
Figure 3C:
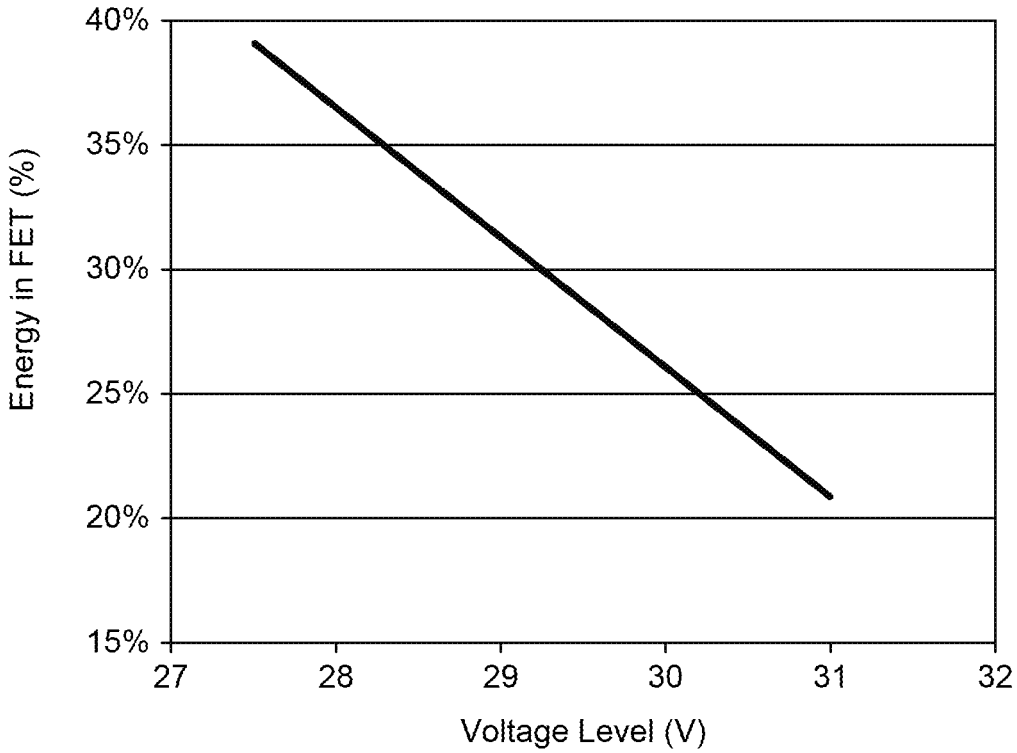

FIG. 3A shows an example of how a pulse in a pulse-width-modulated system increases in duration (measures in microseconds) as a voltage level of a switch logic signal is decreased. In this case a 32V power supply was used. FIG. 3B shows how the total energy dissipated in the printer pen increases as a voltage level of a switch logic signal is decreased. FIG. 3C shows how the energy dissipated in a FET switch increases as a voltage level of a switch logic signal is decreased. This experimental data shows that adding 1 volt implicates a 10% of energy dissipated in extra heat. In these experimental examples, setting the voltage level of a switch logic signal lower than needed, unnecessary increases a TTOE setting, which consequently causes a printer pen to operate in a higher operating energy setting which impacts on pen thermal behavior. It further demonstrates how it is important to match a voltage level at a source terminal of a FET switch to a voltage level of a control signal at a gate terminal. In certain case, an absolute printer-pen power supply voltage variation can be canceled by adjusting a voltage level of a switch logic signal to a constant delta voltage between the printer-pen power supply and the switch logic signal voltage values. Picking the switch logic signal voltage level properly increases efficiency with regard to "extra over energy", i.e. reduces an over-energy budget variation in a printing system and increases a silicon-die thermal performance.

At least some aspects of the examples described herein with reference to the drawings may be implemented using computer processes operating in processing systems or processors. These aspects may also be extended to computer programs, particularly computer programs on or in a carrier, adapted for putting the aspects into practice. The program may be in the form of non-transitory source code, object code, a code intermediate source and object code such as in partially compiled form, or in any other non-transitory form suitable for use in the implementation of processes according to the invention. The carrier may be any entity or device capable of carrying the program. For example, the carrier may comprise a storage medium, such as a solid-state drive (SSD) or other semiconductor-based RAM; a ROM, for example a CD ROM or a semiconductor ROM; a magnetic recording medium, for example a floppy disk or hard disk; optical memory devices in general; etc.

It will be understood that any control circuitry referred to herein may in practice be provided by a single chip or integrated circuit or plural chips or integrated circuits, optionally provided as a chipset, an application-specific integrated circuit (ASIC), field-programmable gate array (FPGA), etc. The chip or chips may comprise circuitry (as well as possibly firmware) for embodying at least a data processor or processors, which are configurable so as to operate in accordance with the described examples. In this regard, the described examples may be implemented at least in part by computer software stored in (non-transitory) memory and executable by the processor, or by hardware, or by a combination of tangibly stored software and hardware (and tangibly stored firmware).

The preceding description has been presented only to illustrate and describe examples of the principles described. This description is not intended to be exhaustive or to limit these principles to any precise form disclosed. Many modifications and variations are possible in light of the above teaching.

What is claimed is:

1. A method of controlling firing energy in a printer pen of a thermal inkjet printer, the method comprising:

obtaining a digital voltage value representative of a voltage output by a printer-pen power supply, the printer-pen power supply being electrically coupled to a switch, the switch being electrically coupled to a nozzle resistor and controlled using a switch logic signal; and setting a voltage level of the switch logic signal based on said digital voltage value and a voltage drop due to a parasitic resistance between the printer-pen power supply and the switch.

2. A method according to claim 1, wherein obtaining a digital voltage value comprises:

measuring a voltage output by the power supply; and converting the voltage output by the power supply to a digital value.

3. A method according to claim 1, wherein the switch comprises a field-effect transistor.

4. A method according to claim 3, wherein setting a voltage level of the switch logic signal comprising supplying the switch logic signal to a gate terminal.

5. A method according to claim 1, wherein setting a voltage level of the switch logic signal comprising setting a voltage level provided by a logic power supply.

6. A method according to claim 1, wherein setting a voltage level of the switch logic signal comprises:

setting a voltage level of the switch logic signal in memory based on said digital voltage value and a voltage drop due to a parasitic resistance between the printer-pen power supply and the switch;

reading the voltage level from memory; and using the voltage level read from memory to set a voltage level provided by a logic power supply.

7. A method according to claim 1, wherein a pulse width of the switch logic signal is set according to a thermal turn-on energy procedure.

8. A method according to claim 1, wherein the parasitic resistance comprises a die resistance between the printer-pen power supply and the switch.

9. A method according to claim 1, wherein the printer-pen power supply is a direct-current power source.

10. A method according to claim 1, wherein setting the voltage level of the switch logic signal comprises:

setting the voltage level of the switch logic signal based on the digital voltage value minus a voltage drop due to a parasitic resistance between the printer-pen power supply and the switch.

11. Apparatus for controlling firing energy in a printer pen of a thermal inkjet printer, the apparatus comprising:

a power supply coupling arranged to receive a voltage output by a printer-pen power supply;

a switch electrically coupled to the power supply coupling and electrically coupled to a logic signal line, the logic signal line carrying a switch logic signal to control the switch;

a nozzle resistor electrically coupled to the switch; and control circuitry arranged to obtain, from the power supply coupling, a digital voltage value representative of the voltage output by the printer-pen power supply and to set a voltage level of the switch logic signal based on said digital voltage value and a voltage drop due to a parasitic resistance of at least the power supply coupling.

12. Apparatus according to claim 11, wherein the control circuitry comprises:

an analog-to-digital convertor for outputting the digital voltage value based on a measured voltage value.

13. Apparatus according to claim 11, wherein the switch comprises a field-effect transistor.

14. Apparatus according to claim 13, wherein:

a source terminal of the field-effect transistor is electrically coupled to a first side of the power supply coupling, the second side of the power supply coupling being electrically coupled to the printer-pen power supply;

a drain terminal of the field-effect transistor is electrically coupled to the nozzle resistor;

a gate terminal of the field-effect transistor is electrically coupled to the logic signal line.

15. Apparatus according to claim 11, comprising:

a printer-pen power supply electrically coupled to the power supply coupling;

a logic power supply electrically coupled to the switch, the control circuitry being arranged to set a voltage level of the logic power supply to set the voltage level of the switch logic signal.

16. Apparatus according to claim 11, wherein the control circuitry comprises:

a memory to store a voltage value representative of the voltage level of the switch logic signal, said voltage value being set in the memory by the control circuitry.

17. Apparatus according to claim 16, wherein the control circuitry is arranged to read said voltage value from the memory and to set the voltage level of the switch logic signal based on the read voltage value.

18. Apparatus according to claim 11, wherein the control circuitry is arranged to set a voltage level of the switch logic signal based on said digital voltage value minus a voltage drop due to a parasitic resistance of at least the power supply coupling.

19. Apparatus according to claim 11, wherein the control circuitry comprises a programmable controller to set the voltage level of the switch logic signal.

20. A computer program product comprising a non-transitory computer-readable storage medium having computer readable instructions stored thereon, the computer readable instructions being executable by a computerized device to cause the computerized device to perform a method for controlling firing energy in a printer pen of a thermal inkjet printer, the method comprising:

obtaining a digital voltage value representative of a voltage output by a printer-pen power supply, the printer-pen power supply being electrically coupled to a switch, the switch being electrically coupled to a nozzle resistor and controlled using a switch logic signal; and setting a voltage level of the switch logic signal based on said digital voltage value and a voltage drop due to a parasitic resistance between the printer-pen power supply and the switch.

* * * * *